US011575216B2

(12) United States Patent
Aurinsalo et al.

(10) Patent No.: US 11,575,216 B2
(45) Date of Patent: Feb. 7, 2023

(54) PHASED ARRAY ANTENNA SYSTEM WITH A FIXED FEED ANTENNA

(71) Applicant: Teknologian tutkimuskeskus VTT Oy, Espoo (FI)

(72) Inventors: Jouko Aurinsalo, Espoo (FI); Antti Lamminen, Espoo (FI)

(73) Assignee: Teknologian tutkimuskeskus VTT Oy, Espoo (FI)

( * ) Notice: Subject to any disclaimer, the term of this patent is extended or adjusted under 35 U.S.C. 154(b) by 0 days.

(21) Appl. No.: 17/281,995

(22) PCT Filed: Sep. 16, 2019

(86) PCT No.: PCT/FI2019/050660
§ 371 (c)(1),
(2) Date: Apr. 1, 2021

(87) PCT Pub. No.: WO2020/070375
PCT Pub. Date: Apr. 9, 2020

(65) Prior Publication Data

US 2021/0336350 A1 Oct. 28, 2021

(30) Foreign Application Priority Data

Oct. 2, 2018 (FI) ..... 20185826

(51) Int. Cl.
*H01Q 21/00* (2006.01)
*H01Q 21/06* (2006.01)
*H01Q 3/46* (2006.01)

(52) U.S. Cl.
CPC ..... *H01Q 21/0025* (2013.01); *H01Q 3/46* (2013.01); *H01Q 21/00* (2013.01);
(Continued)

(58) Field of Classification Search
CPC .. H01Q 21/0025; H01Q 3/46; H01Q 21/0018; H01Q 21/064; H01Q 21/20;
(Continued)

(56) References Cited

U.S. PATENT DOCUMENTS 6,421,021 B1 * 7/2002 Rupp ..... H01Q 21/0025 343/753
6,995,726 B1 2/2006 West et al.
(Continued)

FOREIGN PATENT DOCUMENTS

EP 0618641 A2 10/1994
EP 1597793 B1 8/2008
(Continued)

OTHER PUBLICATIONS

Dussopt et al: A V-Band Switched-Beam Linearly Polarized Transmit-Array Antenna for Wireless Backhaul Applications. IEEE Transactions on Antennas and Propagation, Dec. 2017, vol. 65, No. 12, pp. 6788-6793.
(Continued)

*Primary Examiner* — Hai V Tran
(74) *Attorney, Agent, or Firm* — Laine IP Oy

(57) ABSTRACT

According to an example aspect of the present invention, there is provided an antenna array for a transmit-array antenna system with a fixed feed antenna, comprising an inner radiating surface for receiving a first signal from the fixed feed antenna, an outer radiating surface for emitting a second signal from the antenna array and a platform for electric connection of Radio Frequency, RF, components disposed between the inner and outer radiating surfaces, the platform having a phase shifter for operatively connecting the inner and outer radiating surfaces.

20 Claims, 10 Drawing Sheets

(52) U.S. Cl.
CPC ..... *H01Q 21/0018* (2013.01); *H01Q 21/06* (2013.01); *H01Q 21/064* (2013.01)

(58) Field of Classification Search
CPC ..... H01Q 1/38; H01Q 1/3275; H01Q 9/0428; H01Q 3/242; H01Q 1/085; H01Q 21/08; H01Q 21/205; H01Q 1/2291; H01Q 1/243; H01Q 1/422; H01Q 1/48; H01Q 21/065; H01Q 5/49; H01Q 5/50; H01Q 9/065; H01Q 9/285; H01Q 9/38; H01Q 21/0006; H01Q 21/0037; H01Q 21/0075; H01Q 21/06; H01Q 21/068; H01Q 23/00; H01Q 3/08; H01Q 9/0435; H01Q 21/0087; H01Q 5/15; H01Q 9/16; H01Q 13/085; H01Q 3/30; H01Q 13/06; H01Q 13/10; H01Q 21/061; H01Q 21/30; H01Q 5/42; H01Q 13/28; H01Q 1/1292; H01Q 1/28; H01Q 1/286; H01Q 3/22; H01Q 3/36; H01Q 21/00; H04B 1/3838; H04B 7/0413; H04B 7/086; H04B 1/0458
USPC ..... 343/702
See application file for complete search history.

(56) References Cited

U.S. PATENT DOCUMENTS

| | | | | |
|---|---|---|---|---|
| 7,170,446 | B1 | 1/2007 | West et al. | |
| 9,966,670 | B1 | 5/2018 | Kuo et al. | |
| 2004/0164915 | A1* | 8/2004 | Quan | H01Q 3/22 343/753 |
| 2007/0205955 | A1* | 9/2007 | Korisch | H01Q 21/08 343/797 |
| 2008/0030420 | A1* | 2/2008 | Lee | H01Q 3/46 343/853 |
| 2017/0302003 | A1* | 10/2017 | Elsallal | H01Q 21/061 |

FOREIGN PATENT DOCUMENTS

| | | | |
|---|---|---|---|
| EP | 1597797 | A1 | 4/2010 |
| EP | 2047562 | B1 | 9/2014 |

OTHER PUBLICATIONS

Moknache et al: A Switched-Beam Linearly-Polarized Transmitarray Antenna for V-Band Backhaul Applications. European Conference on Antennas and Propagations (EuCAP), Apr. 10, 2019.

* cited by examiner

PHASED ARRAY ANTENNA SYSTEM WITH A FIXED FEED ANTENNA

FIELD

Embodiments of the present invention relate in general to wireless communication systems and the use of multiple antennas for transmission and/or reception.

BACKGROUND

An antenna array comprises multiple antennas for transmission or reception of radio waves. In an antenna array multiple antennas are connected and arranged such that the antennas are used in cooperation to basically work as a single transmitter or receiver at a time. In general, antenna arrays may be used to achieve higher gains, by exploiting a narrower beam of radio waves compared to transmitting or receiving with a single antenna. Antenna arrays may also be used, for example, to improve reliability by utilizing two or more wireless communication channels with different characteristics, and to mitigate interference coming from certain directions.

In the field of wireless communications beamforming generally refers to directing transmission or reception of radio signals using an antenna array. Direction of transmission or reception may be controlled by modifying the phase and amplitude of a signal at each antenna to increase the performance of transmission or reception for a single data signal.

Exploitation of millimetre waves is one aspect considered for improving the performance of wireless communication systems, because it enables the use of additional frequency spectrum. The use of higher frequencies makes building of antenna arrays comprising more antennas feasible as well, which can be used to enhance achievable gain. The achievable gain depends, at least partly, on the used antenna array. In some applications it is also desirable to have a large beam steering angle range. There is therefore a need for a module for an antenna system which enables high gains and large beam steering angles.

SUMMARY OF THE INVENTION

According to some aspects, there is provided the subject-matter of the independent claims. Some embodiments are defined in the dependent claims.

According to an aspect of the present invention, there is an antenna array for a transmit-array antenna system with a fixed feed antenna, comprising an inner radiating surface for receiving a first signal from the fixed feed antenna, an outer radiating surface for emitting a second signal from the antenna array, and a platform for electric connection of Radio Frequency, RF, components disposed between the inner and outer radiating surfaces, the platform having a phase shifter for operatively connecting the inner and outer radiating surfaces.

In some embodiments, the antenna array may comprise at least two unit cells, wherein each unit cell may comprise a first antenna element on the inner radiating surface of the antenna array and a second antenna element on the outer radiating surface of the antenna array and the platform may be arranged to connect the at least two unit cells and located in between the first and the second antenna elements, wherein the platform comprises a phase shifter for each unit cell. In addition, in some embodiments said antenna elements may be waveguide antenna elements, possibly filled with a dielectric material.

In some embodiments, the size of the antenna array may be m columns and n rows, and m may be equal to n, the antenna array further comprising m*n unit cells, m platforms for electric connection of RF components, wherein each platform may comprise n phase shifters; and each platform may be arranged to connect the n unit cells of each column or the m unit cells of each row. Moreover, in some embodiments the m platforms may be arranged so that a distance between two adjacent platforms of the m platforms is at least a half of a wavelength of the antenna array. In some embodiments, the antenna array may comprise absorber material to fill gaps between two platforms of the m platforms. In some embodiments, first end-fire radiators may be connected to a first end of each phase shifter and second end-fire radiators may be connected to a second end of each phase shifter.

In some embodiments, the platform may be located about in the middle of a column or row of unit cells equidistant from the inner radiating surface and the outer radiating surface. Alternatively, or in addition, in some embodiments the platform may extend from one end of the antenna array to the opposite end of the antenna array.

In some embodiments, the phase shifter may be vector modulator type phase shifter, such as a Monolithic Microwave Integrated Circuit, MIMIC. Moreover, in some embodiments the transmit and/or receive amplifiers may be integrated in the MMIC.

In some embodiments, the platform may be located perpendicularly with respect to apertures of the inner and outer radiating surfaces of the antenna array.

In some embodiments, the antenna array further may comprise at least one connector for bias voltages and control signals, connected to the platform. Alternatively, or in addition, in some embodiments the platform may be arranged to receive the first signal from the fixed feed antenna via the inner radiating surface and transfer the received first signal to the phase shifters via a first transmission line, wherein the phase shifters may be arranged to shift phase and adjust amplitude of the received first signal to generate the second signal and transfer the second signal via a second transmission line to the outer radiating surface and transmit the second signal via the outer radiating surface to free space.

In some embodiments, the platform comprises a printed circuit board, a low-temperature co-fired ceramics, a thin-film substrate, on-chip antenna technology or alumina.

EMBODIMENTS

Figure 1:
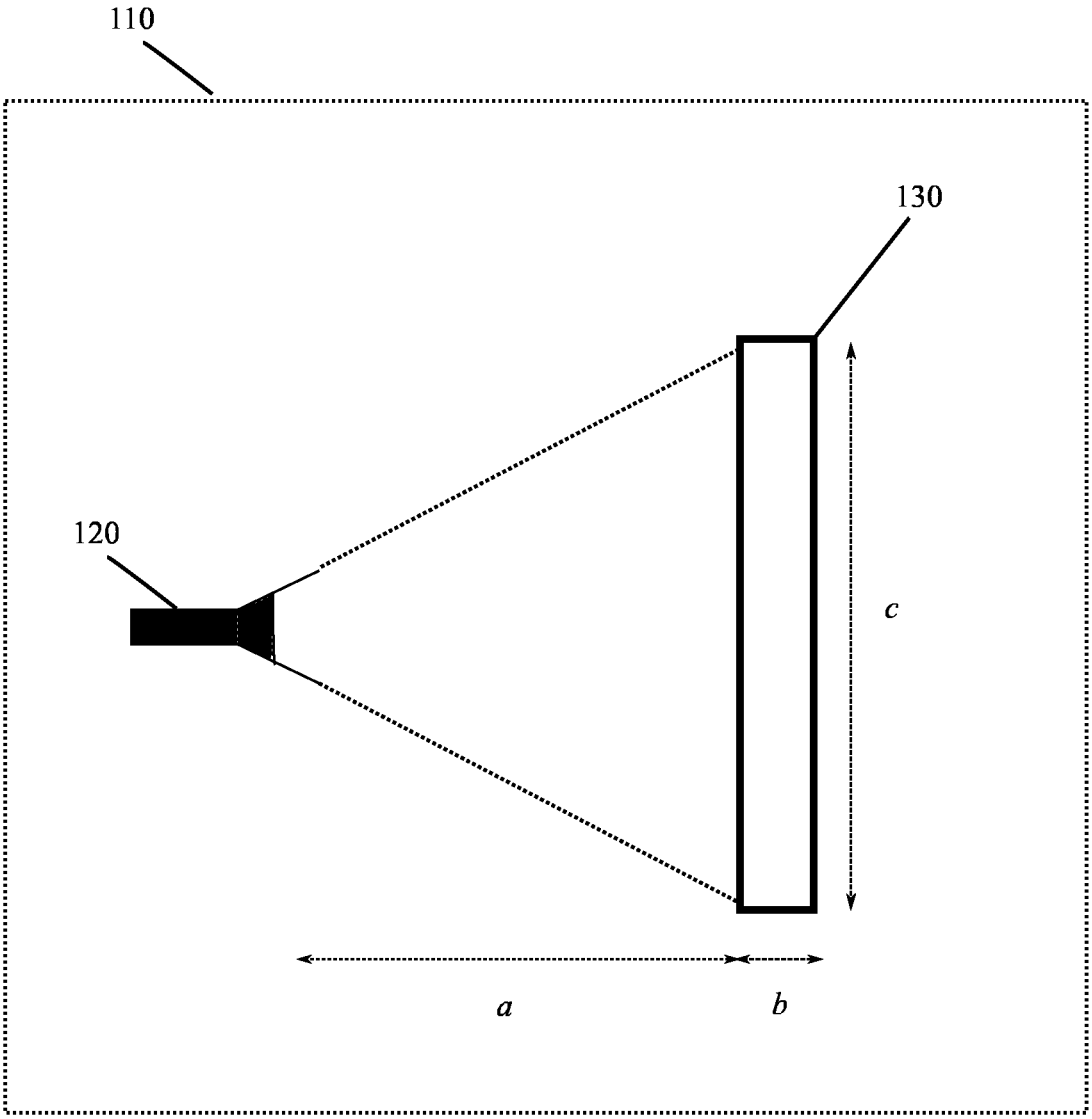
FIG. 1 illustrates an antenna system in accordance with at least some embodiments of the present invention.

Demand for additional frequency spectrum is constantly increasing and hence it is desirable to use higher, millimetre-wave frequencies for wireless communications. Such frequencies are considered, e.g., in the context of 5G networks and for future cellular networks as well. Nevertheless, the embodiments of the invention are not limited to cellular networks and can be exploited in any system that uses antenna arrays. Millimetre-wave frequencies can be used for all kinds of transmissions between wireless devices, including radio access and backhaul connections. The proposed antenna solution is applicable also at least to military communications and radar systems which require a high gain and large beam-steering angle range.

For example, wireless backhaul connections typically require high gain antennas to achieve the required signal-to-noise ratios. In some applications an antenna gain of 30-44 dBi may be required. On top of this requirement the beam-steering range of the antennas should be as large as possible. Certain applications, such as, for example, mesh backhaul networks may require broad beam-steering angles, e.g., at least +/−30 degrees.

Some existing solutions may be able to provide high gains but not broad beam-steering angles due to a limited steering range, which would enable only fine-tuning of the direction of the antenna beam. On the other hand, some other existing solutions may be able to provide broad beam-steering angles but not high gains due to high line losses in complex antenna array feed networks, which limit the maximum gain of the antenna. Thus, there is a need for an antenna system which can provide both, high gain and broad beam-steering angles.

Embodiments of the present invention relate to a novel transmit-array antenna concept, which enables high gain and a large beam-steering angle range. The transmit-array may be fed by a fixed beam antenna, such as, for example, a horn antenna. The transmit-array may comprise two radiating surfaces (inner and outer radiating surfaces). Radiating surfaces may comprise end-fire type radiators. In some embodiments of the present invention an open-ended waveguide may be preferred. However, in some embodiments of the present invention other end-fire elements, such as, for example, dipole, yagi and Vivaldi may be preferred.

The antenna array may comprise at least one Printed Circuit Board, PCB. In some embodiments of the present invention inner and outer radiating surfaces of an antenna array may be connected to each other by the at least one PCB. The at least one PCB may be located perpendicular to the two radiating surfaces. In general, the number of PCBs may be equal to the number columns or rows of the antenna array, depending on whether the PCBs are set vertically or horizontally in the array antenna.

The at least one PCB may be referred to as a platform for electric connection of Radio Frequency, RF, components. In some embodiments, the at least one PCB may be disposed between the inner and outer radiating surfaces. The at least one PCB, i.e, the platform, may be located about in the middle of a column or row of unit cells, equidistant from the inner radiating surface and the outer radiating surface. That is to say, the at least one PCB may be located within the antenna array so that a distance from the inner radiating surface to the at least one PCB is the same as a distance from the outer radiating surface to the at least one PCB.

In some embodiments of the present invention, one PCB may connect unit cells of a column or row of an antenna array. Moreover, the PCB may comprise one phase shifter and, possibly, one amplifier for each unit cell. In some embodiments the phase shifter may be a vector modulator type phase shifter and it may be used for providing a continuous control of a phase and amplitude of a signal. Furthermore, in some embodiments the amplifier may be a Power Amplifier and Low-Noise Amplifier, PALNA, amplifier, which may be used with vector modulators for enabling a bi-directional operation (reception and transmission) using the same antenna array.

The inner radiating surface of the transmit-array may be illuminated by a spatial feeding technique and hence the feed network of the antenna array does not set any limitation to the size of the antenna array. Thus, very high antenna gains are feasible. On the other hand, the amplitude and phase of each antenna element on the outer surface of the transmit-array may be controlled at the input of the element. Therefore the direction of the antenna beam can be steered and the achieved beam-steering angle range may be equal to a phased array antenna.

In summary, the operation of the transmit-array antenna may briefly be explained as follows. For example, a spherical wave radiated by a focal feed source may illuminate the inner radiating elements of the transmit-array. In some embodiments, by the aid of phase shifters and unit cells, the received wave may be transformed into a plane wave radiating from the outer radiating elements to a desired direction. In some embodiments, one unit-cell of the antenna array may comprise one receive antenna element, a phase shifter and a corresponding transmit antenna element. The transmit-array antenna may be referred to as active, if it comprises phase shifters and amplifiers for beam-steering.

FIG. 1 illustrates an antenna system in accordance with at least some embodiments of the present invention. The antenna system (110) may comprise a fixed feed antenna (120) and a transmit-array antenna (130). The fixed feed antenna (120) may be, for example, a feed horn or a fixed beam antenna array. The position of the antenna (120) may be fixed, i.e., the fixed feed antenna (120) does not move, or cannot be moved, during the operation. The antenna array (130) may comprise a waveguide transmit-array with integrated phase shifters and, possibly amplifiers. However, in some embodiments of the present invention other types of end-fire antennas may be possible as well.

In FIG. 1, a denotes the distance between the fixed feed antenna (120) and an inner aperture, i.e., inner radiating surface, of the antenna array (130), b denotes the thickness of the transmit-array (130) from the inner aperture of the antenna array (130) to the outer aperture, i.e., outer radiating surface, of the antenna array (130) and c denotes the width of the antenna array (130). Usually c is the same in x and y directions. Often a is denoted by the focal distance F and c by D and the geometry of the transmit-array is characterized by the F/D ratio, wherein D may be the diameter of the antenna array aperture. For example, typical dimensions of an transmit-array operating in E band (frequencies from 60

GHz to 90 GHz) may be between 30-100 mm for a, 5-20 mm for b and 20-150 mm for c. The width of the antenna array (130), c of 20 mm may correspond to a transmit-array of 8*8 unit cells while 150 mm may correspond to a transmit array of 60*60 elements.

The feed system of the antenna system (110) may be considered as a spatial feeding technique, because the transmitted signal propagates in free space and resembles light in character and behaviour. Such feeding techniques do not suffer from feed line losses which are pronounced in millimetre-wave frequencies like planar antenna array feeding networks. Hence, large and varying losses in the feed system may be avoided, when a large antenna array is implemented. Consequently, it is possible to reduce limitations related to the size of the array imposed by complex and lossy feed networks.

Figure 2:
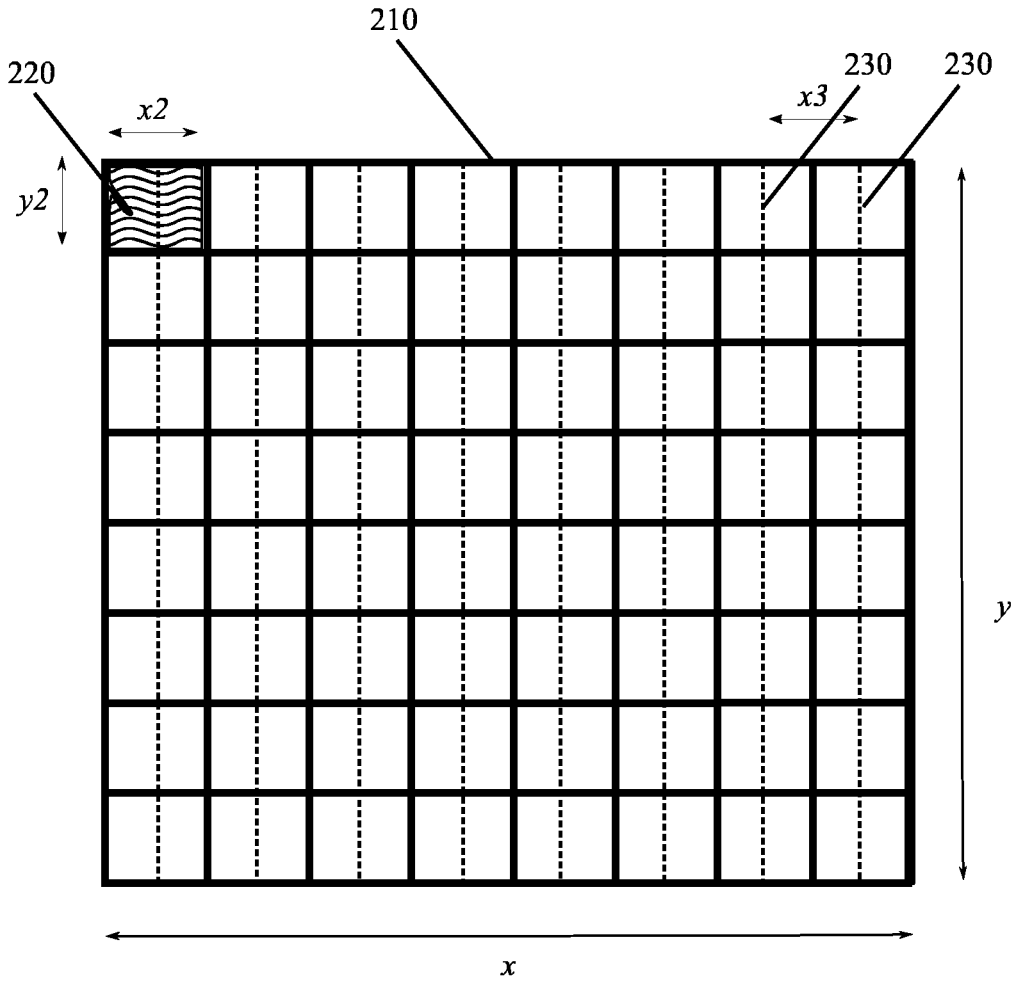
FIG. 2 illustrates a first antenna array of an antenna system in accordance with at least some embodiments of the present invention.

FIG. 2 illustrates a first antenna array of an antenna system in accordance with at least some embodiments of the present invention. The example of FIG. 2 presents a transmit-array (210) with 8*8 unit cells (220), i.e., there are 8 unit cells (220) on the x-axis and 8 unit cells (220) on the y-axis. In some embodiments the lengths of the x- and y-axes may be 20 mm, wherein the x-axis corresponds to parameter c in FIG. 1. In such case the width x2 and length y2 of unit cells (220) would be 2.5 mm. The example of a transmit-array (210) comprises 64 open-ended square unit cells installed in an 8*8 matrix form. One ends of the unit cells form the inner antenna array (inner radiating surface, which is closer to the feed antenna) and the other ends the outer antenna array (outer radiating surface, which is further away from the feed antenna).

In FIG. 2 the dashed line (230) demonstrates a fin-line substrate Printed Circuit Board, PCB, which is set vertically in each column of the transmit-array (210). In other words, one PCB may connect all the unit cells (220) in one column of the antenna array (210). In some embodiments the PCB may be set vertically to the middle, or about middle, of the unit cell (220). The PCB may be located equidistant from the inner radiating surface and the outer radiating surface of the antenna array. That is to say, PCB (230) may be located about middle of the unit cell (220) in a longitudinal direction. The unit cell (220) may be referred to as a square waveguide or an open-ended waveguide as well.

Distance x3 between two PCBs (230) may be equal to the width x2 of a unit cell (220). So as an example, if the width x2 of a unit cell (220) is 2.5 mm, then the distance x3 between two PCBs (230) may be 2.5 mm as well. The thickness of the metallic waveguide wall may be taken into account in the calculation.

In general, by vertical it is meant in a direction defined by the column, namely the direction in which the elements of the column are stacked on each other. One PCB may connect all the inner and outer radiating elements of one column or row to each other. Thus, FIG. 2 demonstrates an embodiment, wherein one PCB connects unit cells vertically. However, in some embodiments one PCB may be set horizontally for connecting the inner and outer radiating elements of unit cells of one row.

Figure 3:
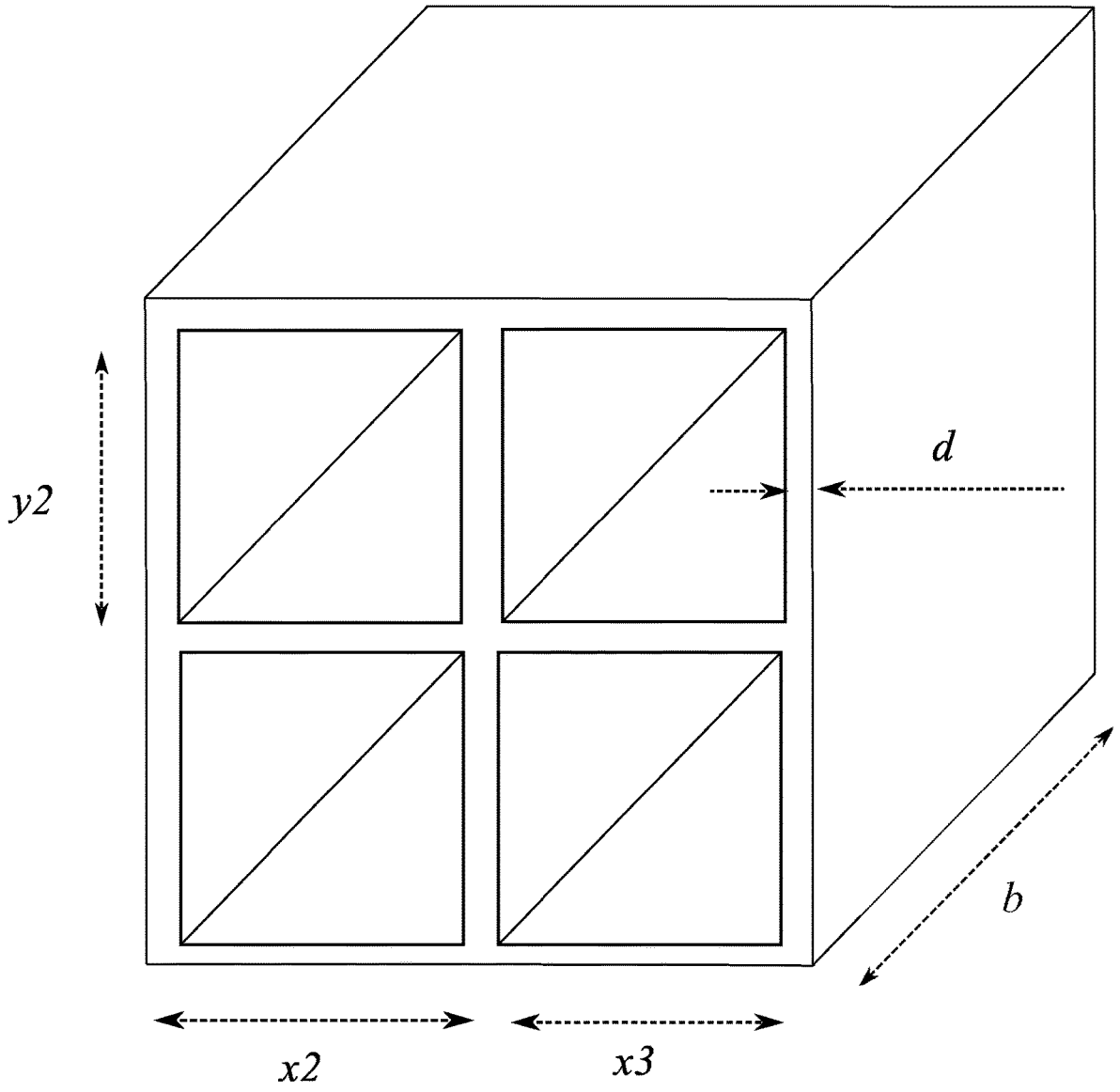
FIG. 3 illustrates a sub-array of an antenna array in accordance with at least some embodiments of the present invention.

FIG. 3 illustrates a sub-array of an antenna array in accordance with at least some embodiments of the present invention. More specifically, FIG. 3 demonstrates a sub-array of an antenna array (210) of FIG. 2. A sub-array of four unit cells is shown. The unit cells of FIG. 3 may correspond to the unit cells (220) of FIG. 2. The unit cells may be three dimensional. Parameters x2 and y2 in FIG. 3 are the same parameters as in FIG. 2 while parameter b corresponds to the thickness of the antenna array (130) in FIG. 1, which may be also referred to as the length of the waveguide sections, extending from the inner aperture to the outer aperture of the antenna array. Parameter d denotes the thickness of the waveguide wall.

As an example, if the spacing of unit cells is 2.5 mm (i.e., if x2 and y2 are 2.5 mm), d may be 0.2 mm, x3 (inside dimension of the waveguide) may be 2.30 mm and b may be 16 mm. In at least some embodiments of the invention a fin-line PCB (not shown in FIG. 3) may be set vertically in the middle, or approximately in the middle, of a square waveguide. In general, a fin-line PCB may be referred to as a PCB which is set to the middle of a rectangular waveguide equidistant from the inner aperture and the outer aperture of the antenna array. The PCB may be set for example in the middle of E plane.

In some embodiments, if considering for example the frequency range of 71-76 GHz, wherein 71 GHz equals to the cut-off frequency of the used waveguide size multiplied by 1.09, or about 1.09, the following ratios of the spacing of elements in wavelengths may be used. In case of 71 GHz, unit cell spacing/wavelength may be 0.59. In case of 73.5 GHz, spacing/wavelength may be 0.61. In case of 76 GHz, spacing/wavelength may be 0.63. By using the multiplier 1.09, or about 1.09, it may be ensured that the unit cell operates sufficiently above the cut-off frequency of the waveguide to avoid loss, but on the other hand the spacing of adjacent unit cells close to a half wavelength may be maintained, to allow a wide angle beam-steering.

According to some embodiments the spacing of the unit cells may be reduced by operating closer to the cut-off frequency. Alternatively, or in addition, the spacing of the unit cells may be reduced by using a dielectric waveguide. That is to say, the unit cells of the transmit-array may be filled with a dielectric material completely or only partially.

Figure 4:
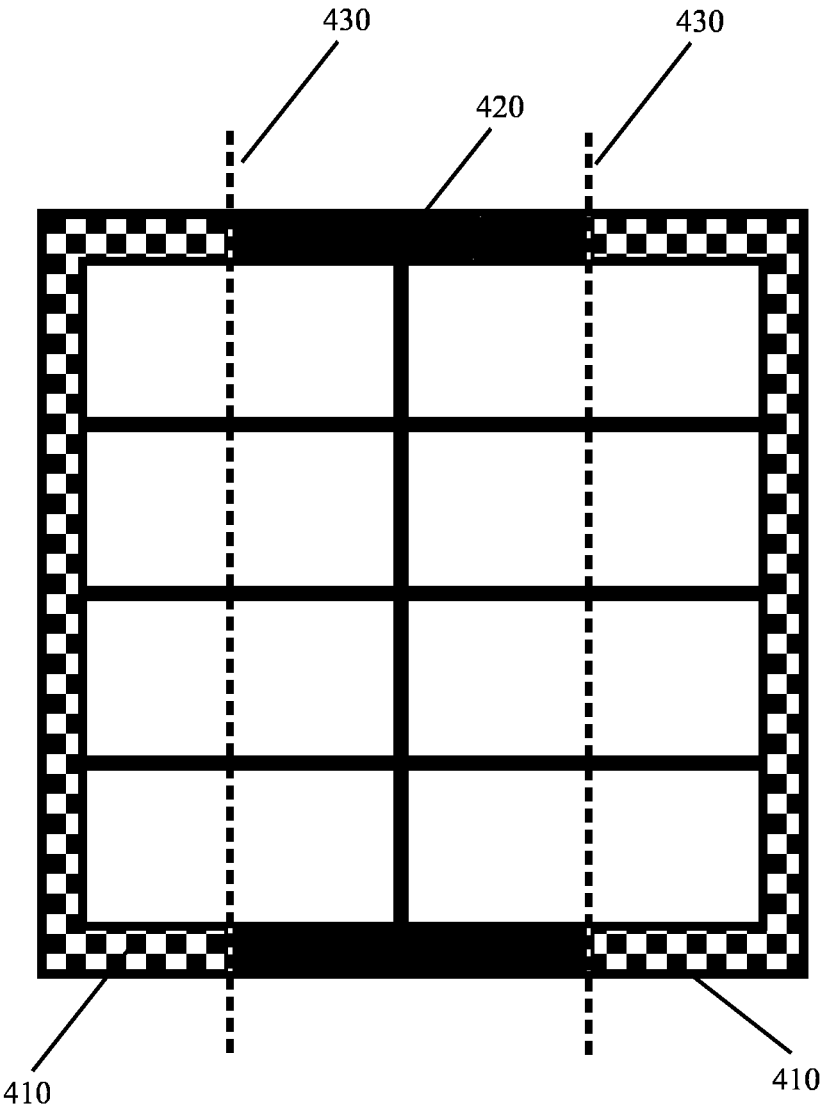
FIG. 4 illustrates a modular mechanical structure of an antenna array in accordance with at least some embodiments of the present invention.

FIG. 4 illustrates a modular mechanical structure of an antenna array in accordance with at least some embodiments of the invention. An antenna array, such as the antenna array (130) in FIG. 1, may have a modular structure comprising certain numbers of three basic parts, which include two metal blocks and a printed circuit board. For example, aluminium may be a suitable metal for the blocks. Such a modular structure is advantageous from the manufacturing and product diversity point of views, to enable efficient manufacturing for example for different antenna gain categories.

Referring to FIG. 4 again, two first elements (410), illustrated in a checkered pattern, are shown which may be required for any antenna array comprising m*n elements, wherein m is the number of columns and n is the number of rows in the antenna array. The first elements (410) may form the ends, or sides, of the waveguide antenna array. Moreover, at least one second element (420) may be required, illustrated in black. For any antenna array comprising m columns, the number of required second elements (420) is m−1.

In addition, there may be one printed circuit board (430) for each column, preferably located in the middle, or about middle, of each column, which may be arranged to connect and support all the unit cells of one column of the transmit-array. Printed circuit board (430) may be located in the middle, or about middle, of the unit cells equidistant from the inner radiating surface and the outer radiating surface of the antenna array. The waveguide/unit cell may be divided into two parts in the middle of the waveguide/unit cell because there is no electric current flow across the waveguide/unit cell longitudinal centre line. For any antenna array comprising m columns, the required number of PCBs (430) may be m. A PCB (430) may be installed in between the first (410) and second (420) elements.

Figure 5:
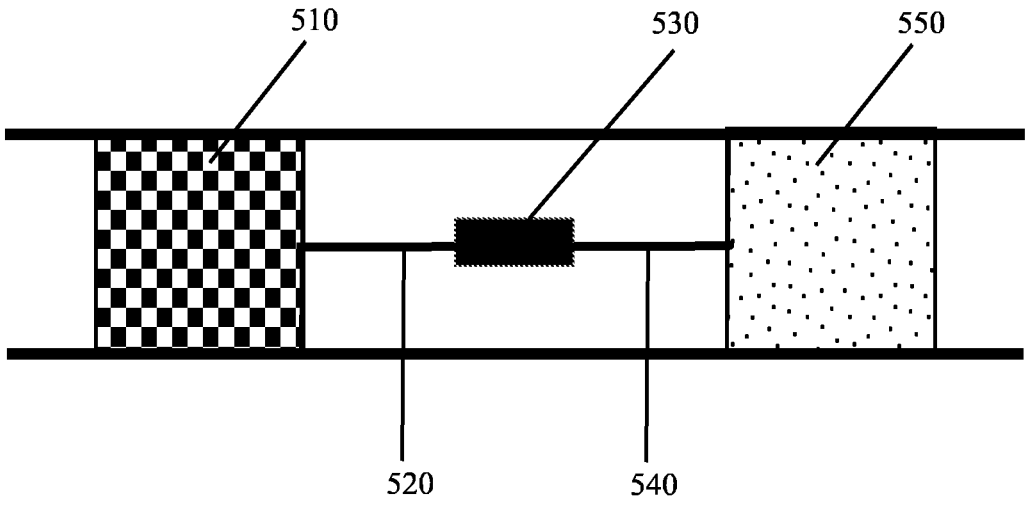
FIG. 5 illustrates a vertical cross-section of one unit cell of the transmit-array.

FIG. 5 illustrates a vertical cross-section of one unit cell of the transmit-array. A unit cell may also be referred to as a waveguide section of the transmit-array. At both ends of the unit cell there may be an open-ended square waveguide acting as a radiating element. One end (510) may act as a radiator on the inner surface of the transmit-array and the other end (550) as a radiator on the outer surface of the transmit-array. There may be a vertical fin-line type PCB in the middle of the structure, i.e., equidistant from the inner radiating surface and the outer radiating surface of the antenna array. The term fin-line may refer to the PCB which is set inside the waveguide, e.g., vertically to the middle of the waveguide.

The PCB may comprise waveguide to transmission line transitions (510 and 550), transmission lines on PCB (520 and 540) and a phase shifter (530), such as a Monolithic Microwave Integrated Circuit, MMIC. Block 510 may convert a signal, received from a fixed antenna feed, from a waveguide mode to a transmission line mode. Respectively, block 550 may convert a signal to be transmitted from the transmission line mode to the waveguide mode. Elements 510 and 550 may be identical. Likewise, elements 520 and 540 may be identical depending on the characteristics of the phase shifter (530). The structure of the waveguide to transmission line transition may vary depending on what type of transmission line (i.e. co-planar waveguide, grounded co-planar waveguide or micro-strip line) is used. Co-planar waveguide, CPW, may suit for flip-chip bonding and micro-strip for wire-bonding assembly of the phase shifter (530).

The phase shifter (530) in the middle of the PCB may be connected to the pads of the transmission lines (520 and 540). The millimetre-wave signal, i.e., first signal, may first coupled from the inner radiating surface by the waveguide transition (510) to the inner transmission line (520) and then propagate to the phase shifter (530). A second signal may be generated by performing a proper phase shift and amplitude adjustment. The second signal may propagate via the outer transmission line (540) and transition (550) to the outer radiating waveguide element, i.e., radiating surface.

The phase shifter (530) may be a vector modulator type phase shifter and assembled on the PCB by using for instance flip-chip bonding. The vector modulator chip may include additional amplifiers to boost the output power in transmission or to decrease noise figure in reception.

The phase shifter (530) may receive a first signal via the first transmission line (520), shift the phase and adjust the amplitude of the signal to generate a second signal. Moreover, the phase shifter (530) may be arranged to transmit the phase shifted second signal via the second transmission line (540). The second transmission line (540) may be a GCPW as well. The PCB may also comprise a block (550) for transitioning the phase shifted second signal so that it is suitable for the outgoing waveguide. The phase shifter may be unidirectional, i.e., it may be able either to transmit or receive the millimetre-wave signal, i.e., first signal. However, also a PALNA amplifier with integrated Rx and Tx vector modulators may be used. This makes it possible to use the same transmit-array antenna both in reception and transmission. In some embodiments, elements 510-550 may be referred to as Radio Frequency, RF, components.

Figure 6:
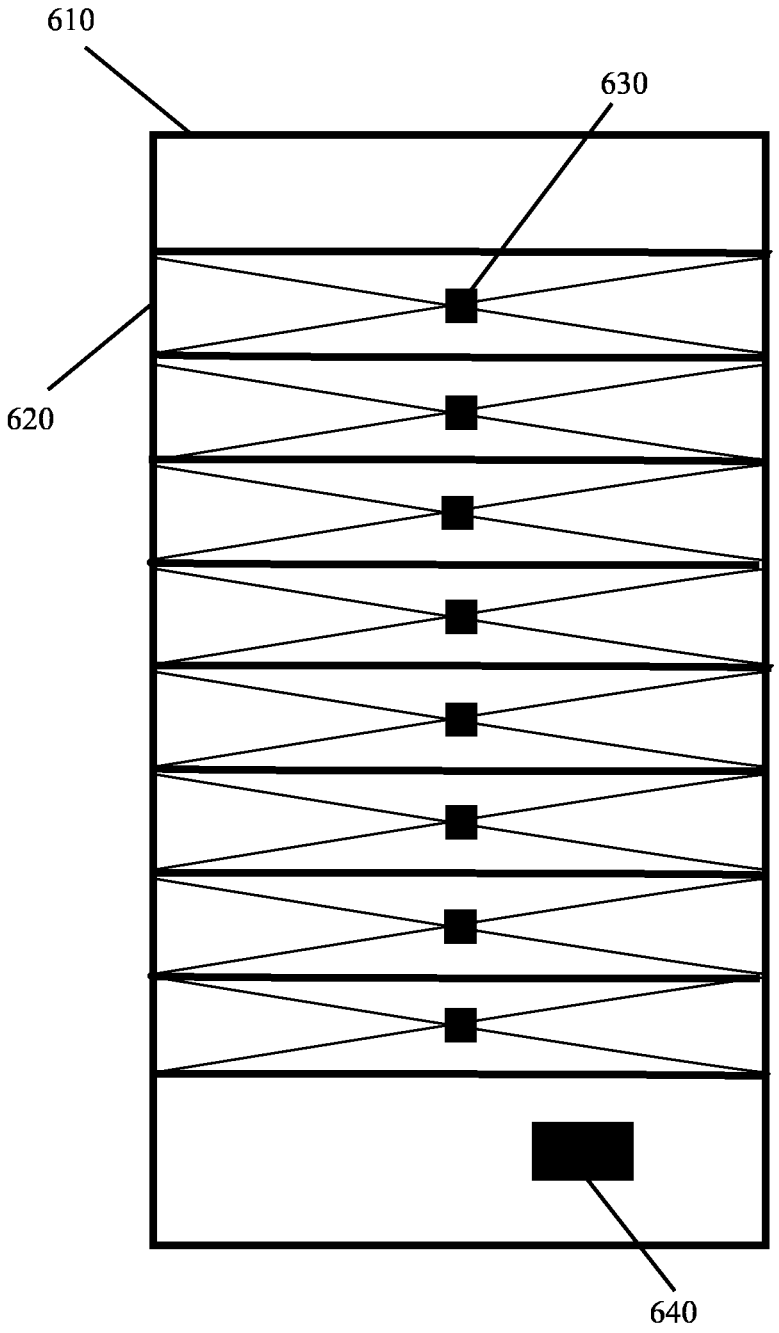
FIG. 6 illustrates a module of an antenna array in accordance with at least some embodiments of the present invention.

FIG. 6 demonstrates a column (610) of a transmit-array antenna comprising 8 unit cells (620). In the column (610) each unit cell (620) may comprise a phase shifter (630). The phase shifter (630) may be a MMIC phase shifter similarly as the phase shifter (530) of FIG. 5. The column (610) of the antenna array may also comprise a connector (640) for active vector modulator bias voltages. The connector (640) may be for vector modulator control signals as well.

In the column (610) one vertical printed circuit board may serve all the unit cells of that column (620). That is to say, in the example of FIG. 6 one printed circuit board may connect 8 radiating antenna elements on the inner radiating surface to the corresponding 8 radiating antenna elements on the outer radiating surface, to form 8 unit cells. In the case of the waveguide transmit-array the column PCB may be located in the middle, or about middle, of the vertically stacked unit cells, which form the column (610). The PCB may be located in the middle, or about middle, of the stacked unit cells equidistant from the inner and outer radiating surfaces. The radiating elements may refer to the open ends of the waveguide sections. One open end may form the inner radiating element and the other open end may form the outer radiating element.

The PCB, comprising phase shifters and amplifiers (630), may be connected to the connector (640) and arranged to receive bias voltages and control signals vertically via the column (610). There may be one or more control signal connectors, which may be located either on the top or the bottom part of the PCB. The phase shifters may hence be controlled by a computer.

The PCB may be set for example in the middle of E plane. In general, the E plane is parallel to the direction of the electric field vector in a waveguide. The orthogonal H plane contains the magnetic field vector. In addition, or alternatively, the printed circuit board may be located perpendicularly with respect to unit cell apertures on the inner and outer radiating surfaces.

Alternatively, or in addition, the waveguide antenna elements may be filled with a dielectric material, i.e., used as a radome. Moreover, the printed circuit boards may be located in the middle, or about the middle of the array unit cells, equidistant from the inner surface and the outer surface of the antenna array.

In an embodiment of the present invention the transmit-array may comprise an open-ended waveguide, which may be used as a unit cell and the vector modulator type phase shifter may be flip-chip bonded to a grounded co-planar waveguide line, GCPW. Therefore, the PCB may include a transition from the waveguide to the GCPW line. There may be various ways to implement the transition but in some embodiments of the present invention two successive transitions may be used. First, there may be a waveguide to micro-strip transition and followed by a transition from micro-strip to GCPW line. The waveguide to micro-strip transition may use an exponentially tapered fin-line section which ends to a short circuit. An open-ended micro-strip stub locating close to the end of the fin-line may act as a coupling element. The fin-line slot and the coupling micro-strip line may be located perpendicularly to each other.

Figure 7:
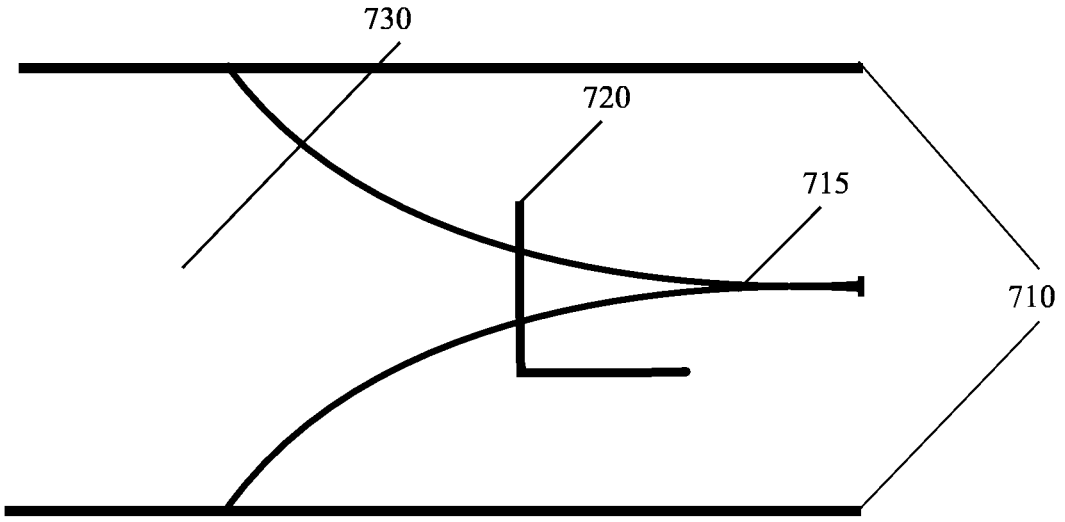
FIG. 7 illustrates a waveguide to microstrip transition in accordance with at least some embodiments of the present invention.

FIG. 7 illustrates a waveguide to micro-strip transition in accordance with at least some embodiments of the present invention. The waveguide (710) may comprise a short circuit (715), a micro-strip stub (720) and a fin-line PCB (730).

In some embodiments, the printed circuit board may be arranged to receive a first signal from the fixed feed antenna via a first open ended waveguide and transfer the received first signal to the phase shifter via a transmission line, e.g. a GCPW line, wherein the phase shifter may be arranged to shift the phase and adjust the amplitude of the received first signal to generate a second signal and transfer then the phase-shifted second signal via the second transmission line, e.g., a GCPW line, to the GCPW to waveguide transition. The open-ended waveguide may act as a radiator. The phase shift of each radiating waveguide element may be adjusted so that the beam of the antenna array points to a certain direction.

Figure 8:
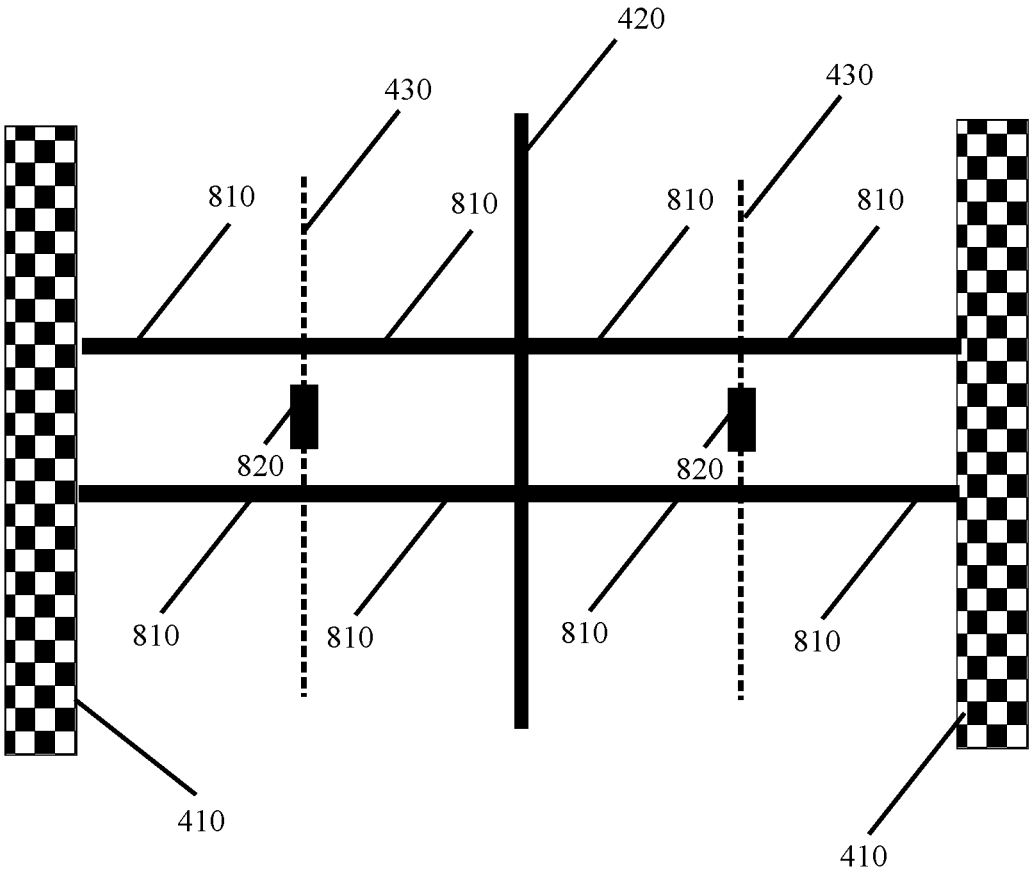
FIG. 8 illustrates a top of view of two unit cells in accordance with at least some embodiments of the present invention.

FIG. 8 illustrates a top of view of two unit cells in accordance with at least some embodiments of the present invention. The metallic waveguide structure (parts 410 and 420 in FIG. 4) may include specific heat bars (810) vertically in front and rear of the vector modulator chips (820) in order to enhance the heat transfer from the phase shifters, e.g., MMICs. In general, the vector modulator chips (820) may be referred to as phase shifters (530) of FIG. 5.

With reference to FIG. 4, the ends of the heat bars (810) may be in contact with the ground planes of the vertical PCBs (430). The heat bars (810) may be integral parts of the metallic blocks 410 and 420. Moreover, the heat bars (810) may be manufactured at the same time as the respective metallic block. In some embodiments, there may be a pipe for a liquid cooling inside the heat bar (810). As an example, water or a mixture of water and glycol may be used as the liquid for cooling.

There may arise a need to shrink the height of the antenna system (dimension a in FIG. 1). The height of the spatial feeding system may be reduced, e.g., by a pill-box or radial parallel plate type feed system. For example, in the pill-box type feed system a slice of a parabolic reflector may be illuminated by a feed horn. The reflecting plane wave between parallel plates may then be coupled by slots to the antenna elements on the inner surface of the transmit-array.

Likewise, in a centre fed radial parallel plate feed system the wave-front propagating radially outwards from the centre point of a low cylinder may be coupled by slots (on top of the cylinder) to the antenna elements on the inner radiating surface of the transmit-array. It should be noted that the present invention supports the integration of these feed systems in a sense that amplitude and phase changes arising in the feed system may be compensated by the vector modulators of the transmit-array.

In some embodiments of the present invention the active transmit-array antenna may be realized by the aid of open ended waveguides with inserted fin-line type PCBs in between. However, according to some embodiments of the present invention there may be alternative ways to realize the transmit-array.

Figure 9:
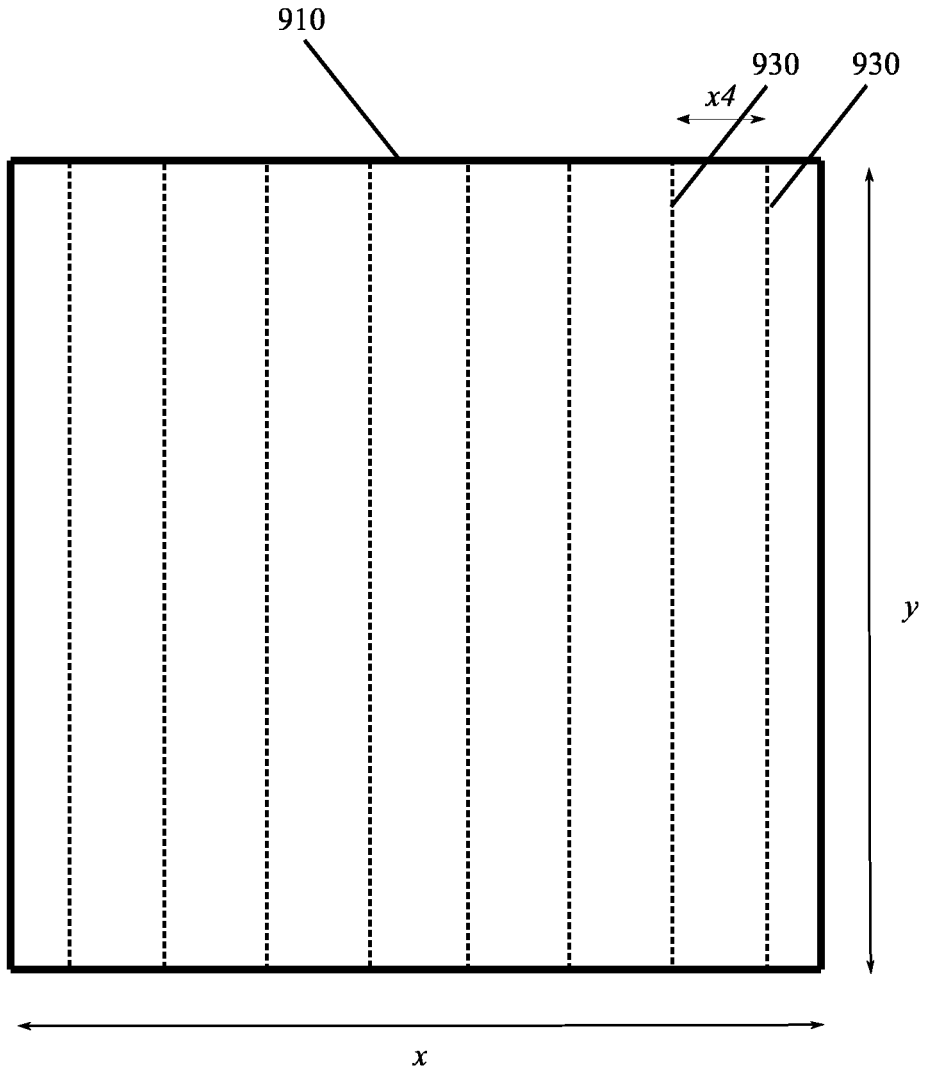
FIG. 9 illustrates a second antenna array of an antenna system in accordance with at least some embodiments of the present invention.

FIG. 9 illustrates a second antenna array of an antenna system in accordance with at least some embodiments of the present invention. With reference to the antenna array of FIG. 2, the waveguides (220) may be omitted from the structure forming the array (910) of FIG. 9. In such a case the transmit-array may comprise vertical PCBs (930), which may be spaced at least at half wavelength distance apart from each other. The distance between the PCBs (930) is denoted by x4 in FIG. 9. With reference to FIGS. 2 and 4, PCBs (930) may correspond to PCBs (230) and (430), respectively. The antenna array of FIG. 9 may comprise an inner radiating surface, an outer radiating surface, and PCB (930). PCB (930) may have a phase shifter for operatively connecting the inner and outer surfaces. Moreover, PCB (930) may be located approximately equidistant from the inner radiating and outer radiating surfaces. In general, PCB (930) may be referred to as a platform for electric connection of Radio Frequency, RF, components disposed between the inner and outer radiating surfaces.

In principle, any type end-fire radiator may be used at both ends of the PCB in the antenna array of FIG. 9. Suitable end-fire radiators include, for instance, Vivaldi, planar dipole, planar tapered slot, planar slot and yagi antennas. In general, end-fire radiators may be referred to as antenna elements.

Figure 10:
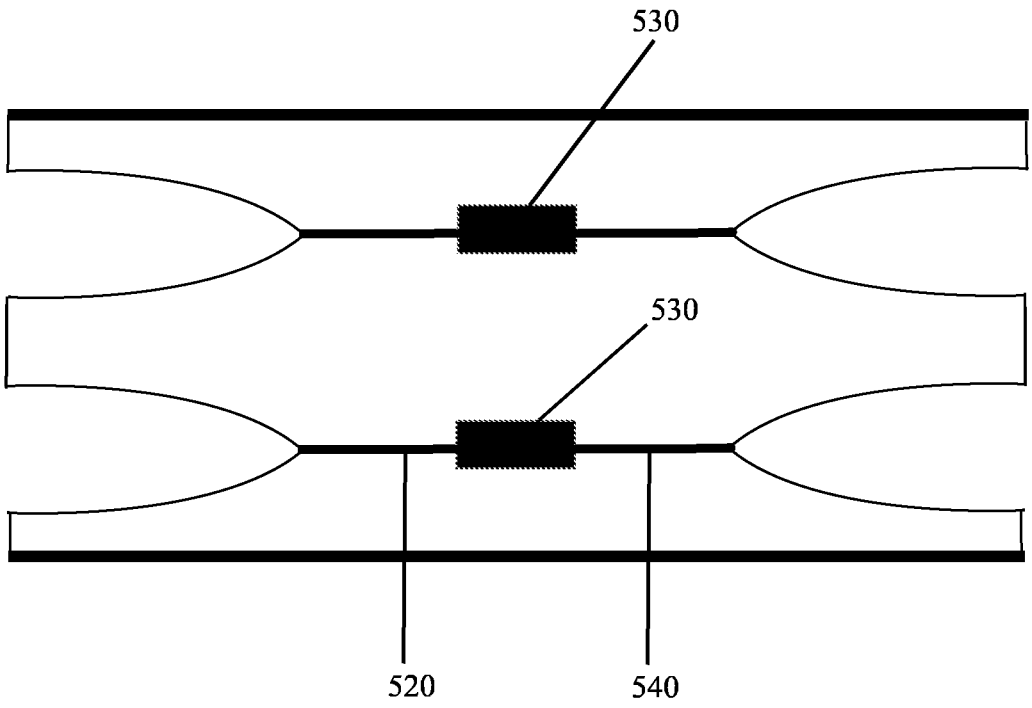
FIG. 10 illustrates a column of an antenna array using a planar tapered slot antenna in accordance with at least some embodiments of the present invention.

Moreover, FIG. 10 illustrates a column of the second antenna array, wherein planar tapered slot antennas are used in accordance with at least some embodiments of the present invention. The column demonstrates a case with two planar tapered slot antennas both on the inner and outer radiating surfaces.

A proper support and spacer structure may be needed for fixing the PCBs to the right position in the second antenna array configuration. Mechanical support may be manufactured in various ways. For example, a similar metal structure may be used as for the waveguides in the first antenna array configuration, but without waveguides. In such as a case, a first metal structure on the inner radiating surface of the antenna array may form a first antenna element and a second metal structure on the outer radiating surface of the antenna array may form a second antenna element. A PCB may be located in the middle, or about middle, of the antenna array, e.g., equidistant from the inner and outer radiating surfaces. Moreover, in some embodiments of the present invention the support may be machined or 3D printed on metal or plastic, etc. Also, spacers may be separate components between the PCBs.

With reference to FIG. 5, the column illustrated in FIG. 10 may comprise transmission lines on PCB (520 and 540) and a phase shifter (530), e.g., MMIC integrated circuit. However, the second antenna array configuration may comprise end-fire antennas without waveguides or finline structures. Thus, as an example, a signal may be coupled from the transmission line (e.g., GCPW) directly to an end-fire antenna.

In the second embodiment, the transmit-array may also comprise absorber material to fill gaps between two printed circuit boards of the m printed circuit boards. Also, in the second embodiment the transmit-array may comprise first end-fire radiators connected to a first end of each phase shifter and second end-fire radiators connected to a second end of each phase shifter.

In the second embodiment, the antenna array may also comprise unit cells. The unit cells of the second embodiment may comprise an inner radiating element/surface, a PCB and outer radiating element/surface. The PCB may further comprise a phase shifter. The PCB may be located in the middle, or about middle, of a column or row of unit cells equidistant from the inner radiating surface and the outer radiating surface.

The first or second embodiment of the present invention may comprise an antenna array for a transmit-array antenna system with a fixed feed antenna. The antenna array may comprise at least two unit cells, wherein each unit cell comprises a first antenna element on an inner radiating surface of the antenna array and a second antenna element on an outer radiating surface of the antenna array. Moreover, the antenna array may also comprise a printed circuit board, connecting the at least two unit cells, wherein the printed circuit board is located in between the first and the second antenna elements and the printed circuit board comprises a phase shifter for each unit cell. In some embodiments, the minimum size of the antenna array for azimuth and elevation beam-steering is four unit cells both on the inner and outer radiating surface, organized into two identical antenna columns.

In the first or second embodiment, the size of the antenna array may be m columns and n rows. The antenna array may comprise m*n unit cells and m printed circuit boards, wherein each printed circuit board may comprise n phase shifters. Each printed circuit board may be arranged to connect the n unit cells of each column or the m unit cells of each row.

The continuous phase and amplitude adjustment of the active vector modulator phase shifter would allow an optimum phase and amplitude excitation for each radiating unit cell for every direction of the antenna beam. Hence, no phase quantization error occurs and thereby no reduction in the antenna directivity. Owing to the amplifiers in the vector modulator no signal loss occurs in the unit cell. On the contrary, the signal may be amplified in the unit cell. The amplification would compensate the inherent loss in the spatial feeding system and possible spill-over loss of the focal feed source. The continuous gain control in the unit-cell would also allow freedom in selecting the F/D ratio of the transmit-array.

Conventionally, unit cells are realized in a planar PCB stack-up which is parallel to the E field of the incoming radio-wave. However, according to some embodiments of the present invention the unit cells may be 3D and realized on multilayer PCBs, which may be located perpendicular to the radiating surfaces of the transmit-array.

Embodiments of the present invention may comprise an antenna array having in minimum two unit cells as described above. However, the invention is particularly advantageous if the number of unit cells in the transmit-array is very large.

In the first or the second embodiment the phase shifters may be vector modulator type phase shifters with associated amplifiers (e.g., LNA and buffer amplifier or PA and buffer amplifier), integrated as for example as a Monolithic Microwave Integrated Circuit, MMIC. Alternatively, or in addition, the phase shifters may be bi-directional phase shifters. In such a case a PALNA type amplifier may be needed. In some embodiments, transmit and/or receive amplifiers may be integrated in the MMIC.

In some embodiments, the transmit-array of the first or the second embodiment may comprise at least one connector for bias voltages and control signals, connected to the printed circuit boards. The phase shifters may be arranged to receive bias voltages and control signals vertically via the column of the antenna array, using the printed circuit board. At least one connector may be connected to the printed circuit board.

Alternatively, or in addition, the printed circuit boards may be located perpendicularly compared to the inner and outer radiating surfaces of the transmit-array. In some embodiments, the printed circuit boards may be located vertically in the antenna array. The antenna array may also have a three-dimensional structure.

In some embodiments, the printed circuit boards may be arranged to receive a first signal from the fixed feed antenna via the inner radiating surface and transfer the received first signal to the phase shifters via first transmission lines, wherein the phase shifters are arranged to shift phase and adjust amplitude of the received first signal to generate a second signal and transfer the phase-shifted second signal via second transmission lines to the outer radiating surface. The printed circuit boards may also be arranged to transmit the phase-shifted signals via the outer radiating surface to free space.

Embodiments of the present invention may also comprise an antenna system, comprising the antenna array of the first or the second embodiment, and the fixed feed antenna for illuminating the inner aperture of the transmit-array.

The structure may be designed so that it prevents EM field from leaking through the array via the gaps between the PCBs. For example, some absorber material may be used for this purpose, such as, for example, ECCOSORB® BSR. The benefit of the waveguide array is the natural isolation between the inner and outer radiating surfaces. On the other hand the end-fire radiators on PCBs allow directly the half wavelength spacing between radiating elements.

In the first and second embodiment the columns (or the rows) of the transmit-array may be realized by other platform technologies suitable for electric connection of Radio Frequency, RF, components instead of PCBs. For example, millimetre-wave platform technologies such as Low Temperature Co-fired Ceramics, LTCC, and thin-film substrates (quartz and silicon) may be used for electric connection of RF components. Furthermore, in some embodiments on-chip antenna technology may be utilized, e.g., at very high frequencies. Also, alumina may be used. In general, a PCB may be referred to as a platform technology for electric connection of RF components.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the preceding description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

In an exemplary embodiment, an apparatus, such as an antenna array, may include means for carrying out embodiments described above and any combination thereof.

INDUSTRIAL APPLICABILITY

At least some embodiments of the present invention find industrial application in wireless communication systems. A module for an antenna array and corresponding methods described herein may be utilized for enabling wireless communications between various devices. The wireless communications may comprise communications between a user device, for example a smart phone, and a base station of a communications network. The wireless communications may also comprise backhaul connections between base stations or between a base station and a relay node. In addition to wireless communications the concept of the presented invention can be applied to radar antennas where a high gain and large beam-steering angle range are needed.

Examples of wireless communications networks comprise Wireless Local Area Networks, WLAN, and 4G and 5G networks. The module for an antenna array may be connected to a base station, e.g. for transmitting and/or receiving radio signals, via the antenna array. The antenna arrays may be utilized at least in base station deployments where high gain antennas with a large beam-steering angle range are appreciated. For example, the antenna array suits particularly well for mesh backhaul networks operating at millimetre-wave frequencies.

Acronyms List 5G 5$^{th}$ Generation
CPW Co-Planar Waveguide
GCPW Grounded Co-Planar Waveguide
LTCC Low Temperature Co-fired Ceramics
MIMIC Monolithic Microwave Integrated Circuit
PCB Printed Circuit Board
PALNA Power Amplifier and Low-Noise Amplifier
RF Radio Frequency
WLAN Wireless Local Area Network

REFERENCE SIGNS LIST

| | |
|---|---|
| 110 | Antenna system |
| 120 | Fixed feed antenna |
| 130, 210, 910 | Antenna array |
| 220, 620 | Unit cell |
| 230, 430, 730, 930, | Printed circuit board |
| 410 | First metal part |
| 420 | Second metal part |
| 510 | Receiving waveguide transition |

-continued

REFERENCE SIGNS LIST

| | |
|---|---|
| 520 | First transmission line, i.e. GCPW line |
| 530, 630 | Phase shifter |
| 540 | Second transmission line, i.e. GCPW line |
| 550 | Transmitting waveguide transition |
| 610 | Column of transmit-array |
| 640 | Control signal connector |
| 710 | A waveguide |
| 715 | Short circuit |
| 720 | Micro-strip stub |
| 810 | Heat bar |
| 820 | Vector modulator chip |

The invention claimed is:

1. An antenna array for a transmit-array antenna system with a fixed feed antenna, comprising:

an inner radiating surface for receiving a first signal from the fixed feed antenna, an outer radiating surface for emitting a second signal from the antenna array, and a platform for electric connection of Radio Frequency, RF, components disposed between the inner and outer radiating surfaces, the platform having a phase shifter for each unit cell, for operatively connecting the inner and outer radiating surfaces; and at least two unit cells, wherein each unit cell comprises a first antenna element on the inner radiating surface of the antenna array and a second antenna element on the outer radiating surface of the antenna array; and the platform is arranged to connect the at least two unit cells and is located in between, and separate from, the first and the second antenna elements.

2. The antenna array according to claim 1, wherein said antenna elements are waveguide antenna elements.

3. The antenna array according to claim 2, wherein the size of the antenna array is m columns and n rows, and m equals to n, the antenna array further comprising:

m*n unit cells;

m platforms for electric connection of RF components, wherein each platform comprises n phase shifters; and each platform is arranged to connect the n unit cells of each column or the m unit cells of each row.

4. The antenna array according to claim 3, wherein the m platforms are arranged so that a distance between two adjacent platforms of the m platforms is at least a half of a wavelength of the antenna array.

5. The antenna array according to claim 2, wherein said waveguide antenna elements are filled with a dielectric material.

6. The antenna array according to claim 1, wherein the size of the antenna array is m columns and n rows, and m equals to n, the antenna array further comprising:

m*n unit cells;

m platforms for electric connection of RF components, wherein each platform comprises n phase shifters; and each platform is arranged to connect the n unit cells of each column or the m unit cells of each row.

7. The antenna array according to claim 6, wherein the m platforms are arranged so that a distance between two adjacent platforms of the m platforms is at least a half of a wavelength of the antenna array.

8. The antenna array according to claim 7, further comprising absorber material to fill gaps between two platforms of the m platforms.

9. The antenna array according to claim 7, further comprising:

first end-fire radiators connected to a first end of each phase shifter; and second end-fire radiators connected to a second end of each phase shifter.

10. The antenna array according to claim 1, wherein the platform is located about in the middle of a column or row of unit cells equidistant from the inner radiating surface and the outer radiating surface.

11. The antenna array according to claim 1, wherein the platform extends from one end of the antenna array to an opposite end of the antenna array.

12. The antenna array according to claim 1, wherein the phase shifters are vector modulator type phase shifters.

13. The antenna array according to claim 12, wherein at least one of: transmit and receive amplifiers are integrated in a Monolithic Microwave Integrated Circuit, MMIC.

14. The antenna array according to claim 12, wherein the phase shifters are Monolithic Microwave Integrated Circuit, MMIC, phase shifters.

15. The antenna array according to claim 1, wherein the platform is located perpendicularly with respect to apertures of the inner and outer radiating surfaces of the antenna array.

16. The antenna array according to claim 1, further comprising at least one connector for bias voltages and control signals, connected to the platform.

17. The antenna array according to claim 1, wherein the platform is arranged to:

receive the first signal from the fixed feed antenna via the inner radiating surface and transfer the received first signal to the phase shifters via a first transmission line, wherein the phase shifters are arranged to shift phase and adjust amplitude of the received first signal to generate the second signal and transfer the second signal via a second transmission line to the outer radiating surface; and transmit the second signal via the outer radiating surface to free space.

18. The antenna array according to claim 1, wherein the platform comprises a printed circuit board, a low-temperature co-fired ceramics, a thin-film substrate, on-chip antenna technology or alumina.

19. The antenna array according to claim 1, wherein the size of the antenna array is m columns and n rows, and m equals to n, the antenna array further comprising:

m*n unit cells;

m platforms for electric connection of RF components, wherein each platform comprises n phase shifters; and each platform is arranged to connect the n unit cells of each column or the m unit cells of each row.

20. The antenna array according to claim 19, wherein the m platforms are arranged so that a distance between two adjacent platforms of the m platforms is at least a half of a wavelength of the antenna array.

* * * * *